US008200107B2

(12) United States Patent
Maezawa

(10) Patent No.: US 8,200,107 B2
(45) Date of Patent: Jun. 12, 2012

(54) IMAGE FORMING APPARATUS

(75) Inventor: Nobuhiro Maezawa, Yamato-koriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 661 days.

(21) Appl. No.: 12/370,961

(22) Filed: Feb. 13, 2009

(65) Prior Publication Data

US 2009/0208232 A1 Aug. 20, 2009

(30) Foreign Application Priority Data

Feb. 14, 2008 (JP) ..... 2008-032654

(51) Int. Cl.
*G03G 15/08* (2006.01)

(52) U.S. Cl. ..... 399/53

(58) Field of Classification Search ..... 399/53, 399/55, 60, 82; 347/140, 158
See application file for complete search history.

(56) References Cited

U.S. PATENT DOCUMENTS

| | | | | |
|---|---|---|---|---|
| 7,254,350 | B2 * | 8/2007 | Kawamura et al. | 399/55 |
| 7,319,826 | B2 * | 1/2008 | Shim | 399/53 X |
| 2006/0153583 | A1 | 7/2006 | Yukutake et al. | |

FOREIGN PATENT DOCUMENTS

| | | | |
|---|---|---|---|
| JP | 4-324469 | A | 11/1992 |
| JP | 2002-62696 | A | 2/2002 |
| JP | 2003-280356 | A | 10/2003 |
| JP | 2005-17631 | A | 1/2005 |
| JP | 2006-195054 | A | 7/2006 |
| JP | 2007-58139 | A | 3/2007 |
| JP | 2007-148134 | A | 6/2007 |

* cited by examiner

*Primary Examiner* — Sandra Brase
(74) *Attorney, Agent, or Firm* — Birch, Stewart, Kolasch & Birch, LLP

(57) ABSTRACT

An image forming apparatus includes a photoreceptor drum, a developing roller, and a control section. The photoreceptor drum is configured to form an electrostatic latent image on a surface thereof in accordance with image data. The developing roller has a surface for bearing a two-component developer at least a partial region of which faces the photoreceptor drum and is configured to be driven so as to feed the developer to the photoreceptor drum. The control section is configured to detect a print coverage for image data to be used during continuous formation of images in accordance with plural image data items and then set a relative velocity of the developing roller to the photoreceptor drum to a higher value when the print coverage is relatively high and set the relative velocity to a lower value when the print coverage is relatively low.

14 Claims, 10 Drawing Sheets

IMAGE FORMING APPARATUS

CROSS REFERENCE

This Nonprovisional application claims priority under 35 U.S.C. §119(a) on Patent Application No. 2008-032654 filed in Japan on Feb. 14, 2008, the entire contents of which are hereby incorporated by reference.

BACKGROUND OF THE INVENTION

The present invention relates to an electrophotographic image forming apparatus and a method of controlling such an image forming apparatus.

Description of the Related Art

An electrophotographic image forming apparatus includes a developing device and a photoreceptor drum and uses a one-component or two-component developer. The one-component developer comprises a toner having a magnetic property, while the two-component developer comprises magnetic particles called "carrier" and a toner.

An image forming apparatus of the type using the two-component developer supplies the toner from a toner cartridge or the like into the developing device. The developing device includes a developing roller having a magnet member therein, and a stirring member. The stirring member mixes the toner with the carrier stirringly to cause toner particles to be attracted on carrier particles by frictional electrification. The developing roller feeds the carrier to the photoreceptor drum. By so doing, the toner supplied from the toner cartridge is transferred to the photoreceptor drum and visualizes an electrostatic latent image formed on the photoreceptor drum into a toner image.

It is necessary for an image forming apparatus of this type to make the density of toner in the developing device have a proper value by adjusting the amount of toner to be supplied from the toner cartridge into the developing device. For this reason, a conventional image forming apparatus is configured to form a toner patch on the photoreceptor drum just after the image forming apparatus has been powered ON and then adjust the amount of toner to be supplied from the toner cartridge into the developer based on the image density of the toner patch (see Japanese Patent Laid-Open Publication No. 2005-17631 for example).

It is desirable that the density of toner in the developing device be readjusted using such a toner patch in the middle of forming plural images. After formation of plural images, however, a time period for which the toner is stirred in the developing device is not stabilized. Since the amount of charge on the toner varies in accordance with the toner stirring time in the developing device, instable stirring time makes it difficult to uniformalize the image density of the toner patch. In attempt to overcome this difficulty, a proposal has been made of an image forming apparatus configured to calculate an average image density of plural images having been formed and correct the image density of the toner patch based on the average image density thus calculated (see paragraph 0082 of Japanese Patent Laid-Open Publication No. 2005-17631 noted above).

With this image forming apparatus, the driving velocity of the developing roller for forming the toner patch is decelerated when the average image density is higher than a threshold value and accelerated when the average image density is lower than the threshold value. During a period of continuous formation of plural images, the driving velocity of the developing roller is held constant.

With the driving velocity of the developing roller held constant during continuous image formation, the amount of toner to be supplied from the developing roller to the photoreceptor drum might become excessive or insufficient when the amounts of toner required by the respective images vary largely. If the driving velocity of the developing roller is sufficiently high, such excess or insufficiency of toner is not likely to occur, but the developer is borne on the developing roller with an increased frequency and, hence, deterioration of the developer progresses easily. This results in an increased danger of forming an image of defective quality due to occurrence of a pinhole or the like.

The present invention intends to provide an image forming apparatus which is capable of keeping right amounts of toner to be supplied to the photoreceptor drum during a period of continuous formation of plural images even when the amounts of toner required by the respective images vary largely and suppressing deterioration of the developer even in such a case, as well as a method of controlling such an image forming apparatus.

SUMMARY OF THE INVENTION

An image forming apparatus according to the present invention includes an image bearing member, a developer bearing member, a required amount detecting section, and a velocity adjusting section. The image bearing member is configured to form an electrostatic latent image on a surface thereof in accordance with image data. The developer bearing member has a developer bearing surface at least a partial region of which faces the image bearing member and is configured to be driven so as to feed a developer to the image bearing member. The required amount detecting section is configured to detect a detection value related to an amount of toner required by an image to he formed during image formation in accordance with image data. The velocity adjusting section is configured to set a relative velocity of the developer bearing member to the image bearing member to a predetermined value when the detection value is equal to and more than a threshold value and set the relative velocity to a lower value than the predetermined value when the detection value is less than the threshold value.

With this arrangement, the driving velocity of the image bearing member or developer bearing member is adjusted based on the amount of toner required by an image to be formed during image formation. Therefore, even when the amounts of toner required by respective images vary largely during a period of continuous formation of the plural images, an adequate amount of toner can be supplied from the developer bearing member to the image hearing member by appropriately adjusting the driving velocity of the image bearing member or developer bearing member. Even in this case, it is possible to prevent the developer from deteriorating excessively by decelerating the relative velocity, thereby to suppress the danger of forming an image of defective quality. In cases where the amount of toner required by each image is very large, the likelihood of occurrence of a thin spot in a printed image is substantially constant even when the amount of toner to be supplied is increased. Therefore, deterioration of the developer can be prevented effectively by setting the relative velocity to the predetermined value without increasing the relative velocity.

The foregoing and other features and attendant advantages of the present invention will become more apparent from the reading of the following detailed description of the invention in conjunction with the accompanying drawings.

DETAILED DESCRIPTION OF THE INVENTION

Hereinafter, embodiments of the present invention will be described with reference to the drawings.

Figure 1:
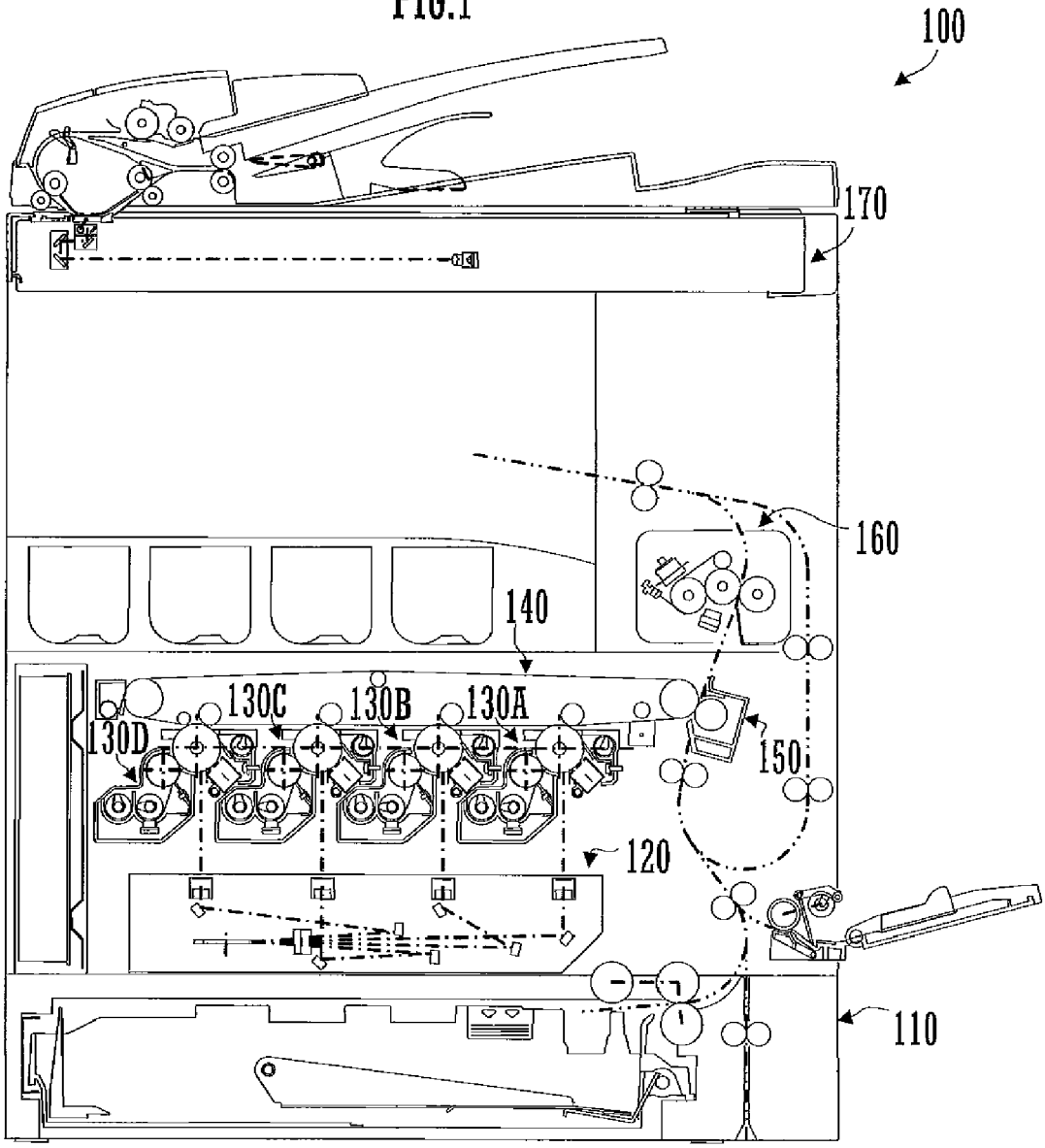
FIG. 1 is a sectional front elevational view schematically illustrating an image forming apparatus according to an embodiment of the present invention.

FIG. 1 is a sectional front elevational view schematically illustrating an image forming apparatus according to an embodiment of the present invention. Image forming apparatus 100 is a color image forming apparatus which uses four color developers for yellow, magenta, cyan and black. The color developers are each a two-component developer comprising a toner and a carrier. The image forming apparatus 100 forms a color image or a monochrome image on a recording sheet as a recording medium in accordance with image data. Such image data is read by a document reader, such as a scanner, or received from terminal equipment, such as a PC (personal computer), via a non-illustrated network.

The image forming apparatus 100 includes a sheet feeding unit 110, image forming units 130A to 130D, an exposure unit 120, an intermediate transfer unit 140, a secondary transfer unit 150, a fixing unit 160, and a document reader 170.

The document reader 170 reads document sheets placed on top of a platen one by one. The sheet feeding unit 110 accommodates therein a multiplicity of recording sheets. The exposure unit 120 emits laser light in accordance with image data inputted.

Each of the image forming units 130A to 130D forms a toner image of any one of the colors: cyan, magenta, yellow and black obtained by color separation of color image data. The intermediate transfer unit 140 includes an endless intermediate transfer belt and transfers toner images of the respective colors formed by the image forming units 130A to 130D to the intermediate transfer belt. The secondary transfer unit 150 transfers a toner image from the intermediate transfer belt to a recording sheet fed from the sheet feeding unit 110. The fixing unit 160 fixes the toner image on the recording sheet by heat.

Figure 2:
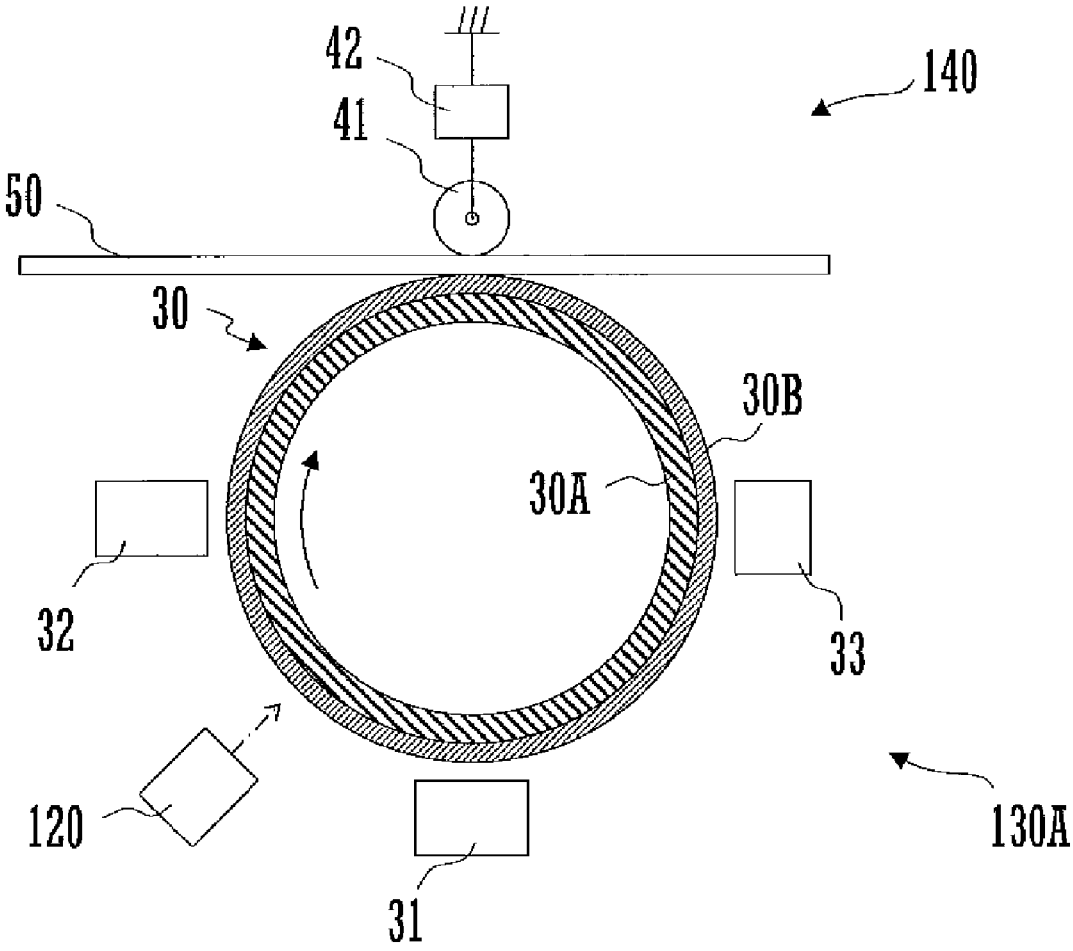
FIG. 2 is a view schematically illustrating an image forming unit of the image forming apparatus shown in FIG. 1.

FIG. 2 is a view schematically illustrating a peripheral arrangement of the image forming unit 130A.

The image forming unit 130A includes a photoreceptor drum 30 which is equivalent to the image bearing member defined by the present invention. Around the photoreceptor drum 30 there are provided an electrostatic charger device 31, exposure unit 120, developing device 32, primary transfer roller 41, and cleaning device 33, which are arranged in this order in the direction of rotation of the photoreceptor drum 30. The primary transfer roller 41 is positioned to face the photoreceptor drum 30 across the intermediate transfer belt 50.

The photoreceptor drum 30 includes a metal drum 30A and a thin film photoconductive layer 30B and is rotatable clockwise in FIG. 2. The metal drum 30A comprises a metal material such as aluminum. The photoconductive layer 30B, which is formed over the outer periphery of the metal drum 30A, is formed from a material such as an organic photoconductor (OPC) or amorphous silicon (a-Si).

The electrostatic charger device 31 is a corona charger comprising a charger wire, such as a tungsten wire, a metal shield plate, a grid plate, and the like. The electrostatic charger device 31 electrostatically charges a peripheral surface of the photoreceptor drum 30 to a uniform potential. The electrostatic charger device 31 may be a contact-type electrostatic charger roller or brush, or the like instead of the corona charger.

The exposure unit 120 scans the peripheral surface of the photoreceptor drum 30 with laser light by means of a semiconductor laser and a polygon mirror. A portion of the photoreceptor drum 30 that is irradiated with a laser beam loses its electric potential by the photoconductive action of the photoconductive layer. Here, laser scanning is performed in accordance with an image data item for black and, hence, an electrostatic latent image corresponding to the image data item for black is formed on the photoreceptor drum 30. The exposure unit 120 may comprise a laser scanning unit (LSU) or a writing device having an array of light-emitting devices.

Here, the developing device 32 contains a black toner therein and supplies the toner to the peripheral surface of the photoreceptor drum 30. The toner is electrostatically charged to have the same polarity as the surface potential of the photoreceptor drum 30. In the present embodiment, the toner is negatively charged.

The primary transfer roller 41 transfers a toner image borne on the peripheral surface of the photoreceptor drum 30 to the intermediate transfer belt 50. For this purpose, the primary transfer roller 41 is applied from an element 42 with a transfer bias voltage having a positive polarity, which is opposite to the polarity of the toner charged. Thus, the black toner image formed on the photoreceptor drum 30 is transferred to the intermediate transfer belt 50.

Though the description of the image forming units 130B to 130D will be omitted, each of these units has the same peripheral arrangement as the image forming unit 130A. The toner images of the respective colors formed by the respective image forming unit 130A to 130D are superimposed one upon another on the intermediate transfer belt 50, thereby forming a full-color toner image.

The cleaning device 33 collects residual toner remaining on the photoreceptor drum 30.

Figure 3:
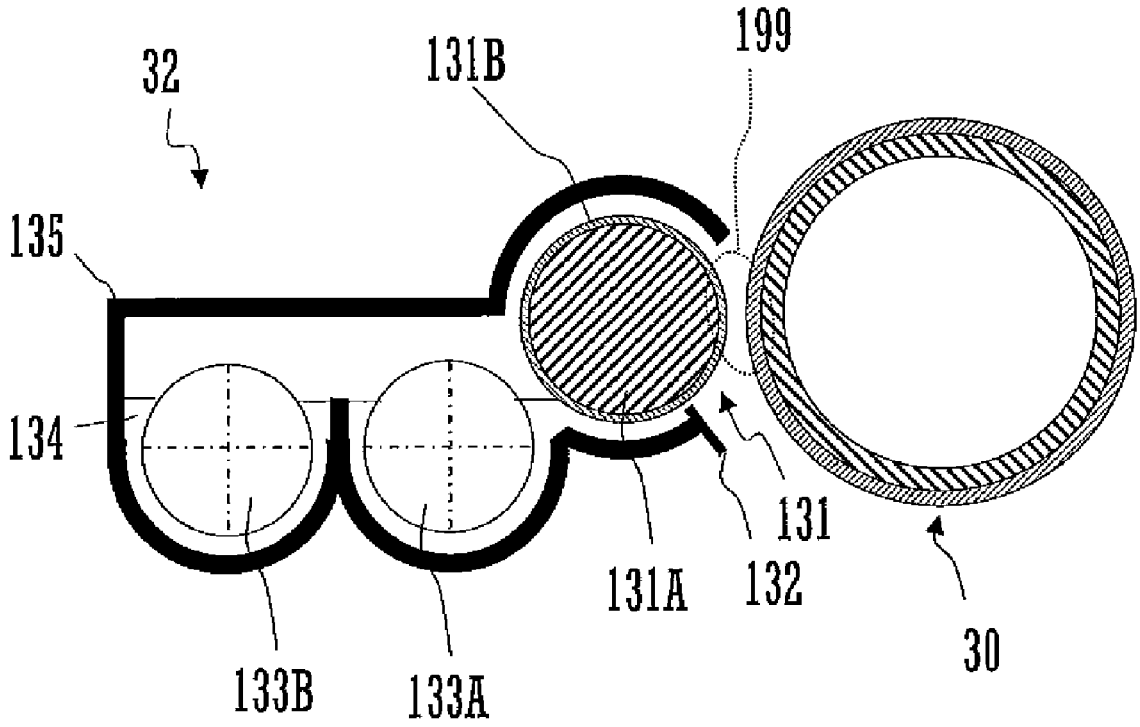
FIG. 3 is a view illustrating an arrangement of a developing device included in the image forming unit shown in FIG. 2.

FIG. 3 is a view illustrating the arrangement of the developing device 32.

The developing device 32 includes a developing housing 135, two-component developer 134, stirring screws 133A and 133B, doctor blade 132, and developing roller 131. The developing roller 131 is equivalent to the developer bearing member defined by the present invention.

The developing housing 135 is a container containing the two-component developer 134 and has an opening in a portion facing the photoreceptor drum 30.

The two-component developer 134 comprises a toner having a particle diameter of 6.2 μm and a carrier comprising magnetic particles having a particle diameter of 50 μm. Each carrier particle attracts toner particles on the surface thereof by the Coulomb force resulting from frictional electrification. The particle diameters of the toner and carrier may be different from the particles diameters noted above.

The stirring screws 133A and 133B stir the toner and the carrier mixingly to cause them to be frictionally electrified. A partition wall intervenes between the stirring screws 133A and 133B except in spaces around opposite ends of each of the stirring screws 133A and 133B along the axis of rotation.

The doctor blade 132 is attached to the developing housing 135 at a position below the opening of the developing housing 135. The doctor blade 132 has a tip facing the peripheral surface of the developing roller 131 across an intervening gap and restricts the layer thickness of the two-component developer 134.

The developing roller 131 comprises a developing sleeve 131B and a magnet roller 131A. The peripheral surface of the developing sleeve 131B is partially exposed from the opening of the developing housing 135. The exposed peripheral surface faces the peripheral surface of the photoreceptor drum 30 across a gap having a predetermined dimension. The gap is set to have any dimension within a range from about 0.3 mm to about 1.0 mm. The developing sleeve 131B is a cylindrical member comprising a non-magnetic material, such as aluminum or stainless steel, and is rotatably fitted over the magnet roller 131A. The magnet roller 131A has a plurality of magnetic poles arranged circumferentially. The developing roller 131 rotates counterclockwise in FIG. 3.

With the above-described arrangement, the carrier of the two-component developer 134 stored below the developing roller 131 is attracted onto the peripheral surface of the developing sleeve 131B by a magnetic field produced by the magnet roller 131A and then fed upwardly with rotation of the developing roller 131. At that time, the doctor blade 132 restricts the layer thickness of the two-component developer 134.

The developing sleeve 131B is applied with a developing bias voltage. The developing bias voltage is a voltage comprising a direct current component and an alternating current component which are superimposed upon each other and exerts a force causing toner particles carried on carrier particles to jump between the developing roller 131 and the photoreceptor drum 30. Such jumping occurs in a developing region 199 in which the developing sleeve 131B and the photoreceptor drum 30 come closest to each other. Thus, toner particles are attracted onto the electrostatic latent image formed on the photoreceptor drum 30 to form the toner image on the photoreceptor drum 30.

The rotating velocity of the developing sleeve 131B is variably controlled. If the rotating velocity of the developing sleeve 131B is constant, the two-component developer 134 is fed into the developing region 199 at a constant feed rate per unit time. However, since the rotating velocity of the developing sleeve 131B is variably controlled, the two-component developer 134 is fed into the developing region 199 at a variable feed rate per unit time in accordance with the rotating velocity variably controlled.

Here, the rotating velocity of the photoreceptor drum 30 is set constant. Therefore, the amount of the two-component developer 134 supplied per unit area of the photoreceptor drum 30 through the developing region 199 is proportional to the feed rate at which the two-component developer 134 is fed into the developing region 199 per unit time. The rotating velocity of the photoreceptor drum 30 may be variably controlled in accordance with the resolution of image data or the magnification of an image. In this case, the amount of the two-component developer 134 to be supplied per unit area of the photoreceptor drum 30 through the developing region 199 may be controlled by correcting the rotating velocity of the developing roller 131 in accordance with the rotating velocity of the photoreceptor drum 30.

Carrier and residual toner, which have not been used for development, of the developer fed into the developing region 199 are fed back into the developing housing 135 by rotation of the developing sleeve 131B.

Figure 4:
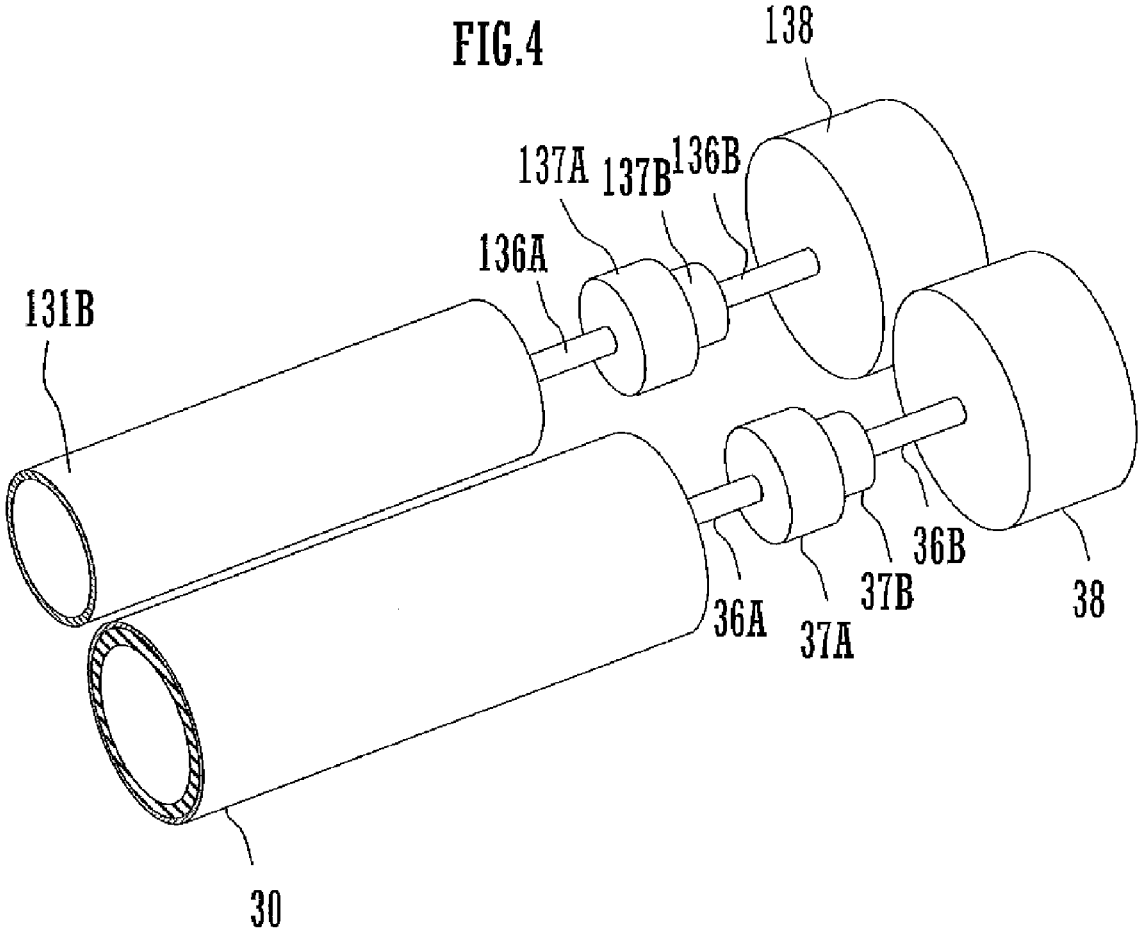
FIG. 4 is a perspective view illustrating peripheral structures of driving sections each associated with a respective one of a developing sleeve and a photoreceptor drum in the image forming unit shown in FIG. 2.

FIG. 4 is a view illustrating driving sections each associated with a respective one of the developing sleeve 131B and the photoreceptor drum 30.

The developing sleeve 131B is joined to a driving shaft 136A. The driving shaft 136A has an end provided with a coupling gear 137A. A developing sleeve motor 138 is joined to a driving shaft 136B. The driving shaft 136A has an end provided with a coupling gear 137B. The coupling gears 137A and 137B have respective toothed surfaces meshing with each other to transmit torque exerted on the driving shaft 136B by the operation of the developing sleeve motor 138 to the developing sleeve 131B via the driving shaft 136A. The photoreceptor drum 30 is joined to a driving shaft 36A. The driving shaft 36A has an end provided with a coupling gear 37A. A photoreceptor drum motor 38 is joined to a driving shaft 36B. The driving shaft 36B has an end provided with a coupling gear 37B. The coupling gears 37A and 37B have respective toothed surfaces meshing with each other to transmit torque exerted on the driving shaft 36B by the operation of the photoreceptor drum motor 38 to the photoreceptor drum 30 via the driving shaft 36A. The developing sleeve motor 138 and the photoreceptor drum motor 38 operate independently of each other at respective angular velocities in accordance with a developing sleeve driving signal and a photoreceptor drum driving signal, which are transmitted from a control section.

Figure 5:
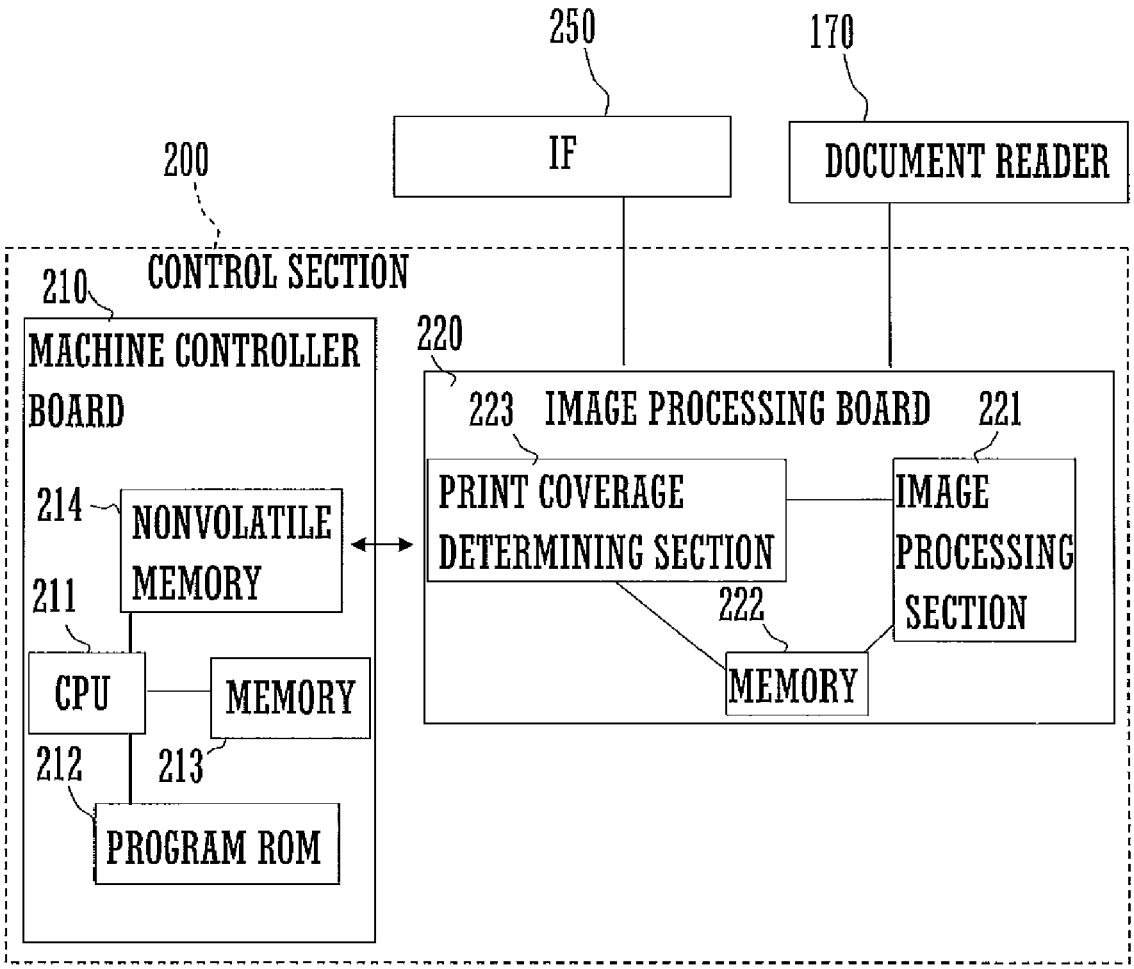
FIG. 5 is a block diagram illustrating a functional configuration of a control section included in the image forming apparatus shown in FIG. 1.

FIG. 5 is a block diagram illustrating the control section of the image forming apparatus 100.

Control section 200 comprises plural control boards. FIG. 5 shows a machine controller board 210 and an image processing board 220, which form the control section 200. The machine controller board 210 controls the general operation of the image forming apparatus 100 including the operations of the photoreceptor drum and developing roller. The image processing board 220 mainly carries out image processing on image data transmitted from a network interface 250 or the document reader 170.

The image processing board 220 includes an image processing section 221, memory 222, and print coverage determining section 223. The image processing section 221 produces image data items for the respective four colors: black, cyan, magenta and yellow from color image data. The memory 222 stores therein the image data items for the respective colors. The print coverage determining section 223 determines a print coverage for each image data item. Data on the print coverage for each color determined by the print coverage determining section 223 is transmitted to the machine controller board 210.

The "print coverage", as used herein, is a ratio of the number of dots to be printed to a maximum number of dots that can be printed on a sheet surface. Since the amount of toner required by image data can be estimated from the print coverage, the present embodiment uses the print coverage as the detection value related to the required amount of toner. For this reason, the print coverage determining section 223 is equivalent to the required amount detecting section defined by the present invention.

The machine controller board 210 includes a CPU 211, program ROM 212, memory 213, and nonvolatile memory 214. The memory 213 stores therein data on print coverage for the respective colors transmitted from the image processing board 220. Also, the memory 213 has cumulatively stored therein print coverage data on plural image data items having been finished with image formation.

The program ROM 212 has stored therein plural programs for use in various processes. The program ROM 212 has necessarily stored therein a control program for controlling the driving velocities of the developing rollers for the respective colors. The CPU 211 reads the developing roller control program out of the program ROM 212 and executes this program. The CPU 211 and the program ROM 212 form the velocity adjusting section defined by the present invention.

The program ROM 212 has also stored therein a control program for controlling the driving velocities of the photoreceptor drums for the respective colors. The CPU 211 reads the photoreceptor drum control program out of the program ROM 212 and executes this program. Therefore, the CPU 211 and the program ROM 212 form the image bearing member velocity adjusting section defined by the present invention also. The developing roller control program and the photoreceptor drum control program need not necessarily be executed by the same control board, but either of these programs may be executed by another control board.

The program ROM 212 has also stored therein a control program for controlling developing bias voltages to be applied to the developing rollers for the respective colors. The CPU 211 reads the developing bias voltage control program out of the program ROM 212 and executes this program. The CPU 211 causes the memory 213 to store therein the values of developing bias voltages every time image printing is performed. Before the image forming apparatus is powered OFF, the CPU 211 reads out these developing voltage values, calculates an average developing bias voltage, and stores the average developing bias voltage into the nonvolatile memory 214. Therefore, the CPU 211 and the program ROM 212 form the bias voltage detecting section defined by the present invention also, while the nonvolatile memory 214 is equivalent to the nonvolatile storage section defined by the present invention.

Figure 6:
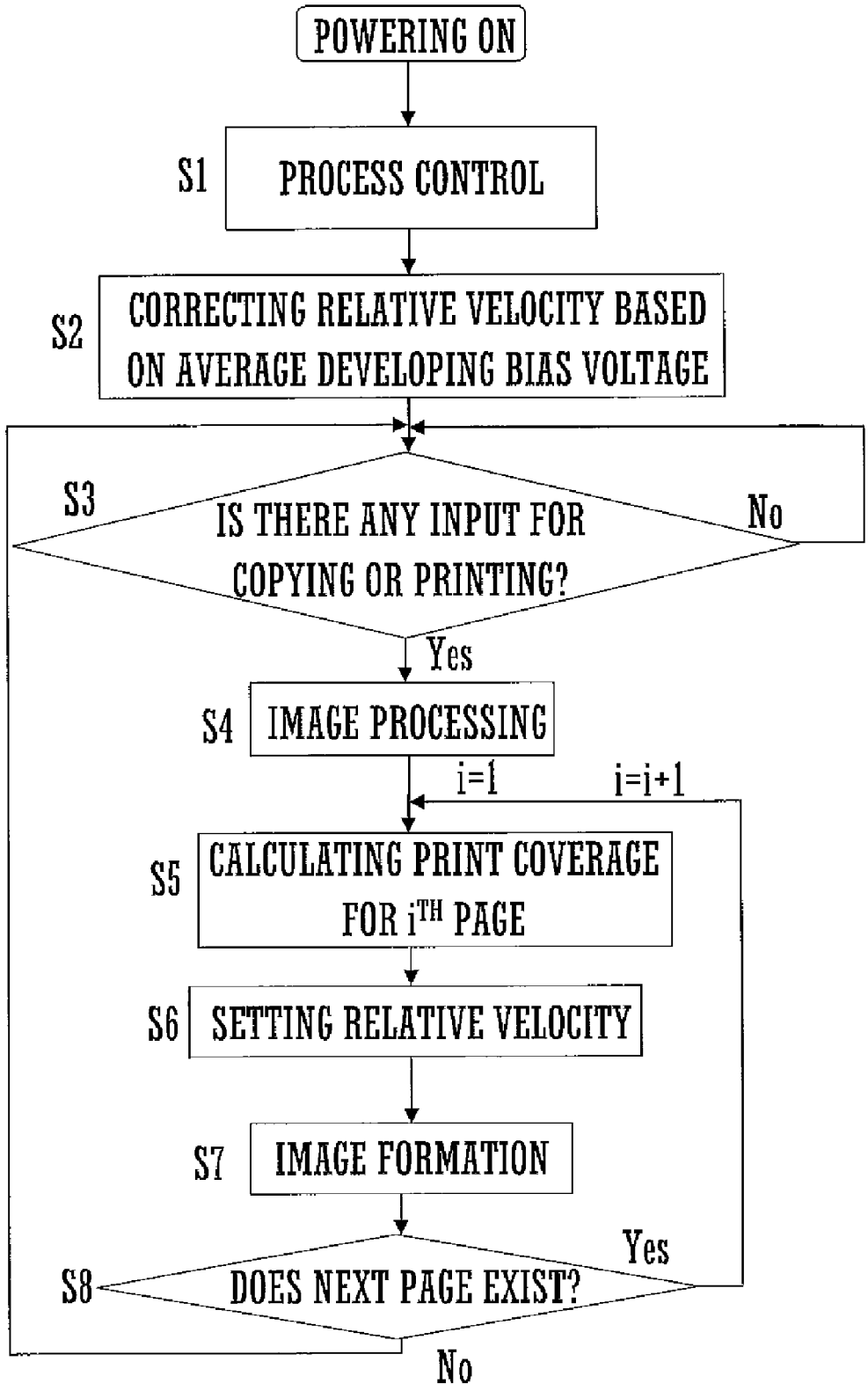
FIG. 6 is a flowchart illustrating an exemplary control flow performed by the control section.

FIG. 6 is a flowchart illustrating an exemplary control flow carried out by the control section. Here, description will be made of a control flow for processing an image data item for black by controlling the image forming unit 130A. Though the description of a control flow for each of the image forming units 130B to 130D is omitted herein, the control flow for each of the image forming units 130B to 130D is the same as for the image forming unit 130A.

When the image forming apparatus 100 is powered ON, the control section 200 performs a process control in step S1. This process control comprises common processing described in Japanese Patent Laid-Open No. 2005-17631 or the like which includes setting the developing bias voltage and supplying the developing device with a toner.

Subsequently, the control section 200 performs step S2 of correcting a relative velocity based on the developing bias voltage. Specifically, the CPU 211 of the machine controller board 210 reads the average developing bias voltage obtained before the last powering-OFF out of the nonvolatile memory 214. Also, the CPU 211 detects the developing bias voltage set by the process control. When there is an increase in developing bias voltage value, the set value of the relative velocity to be described later is corrected to a higher value.

By thus correcting the set value of the relative velocity to a higher value in accordance with a change in developing bias voltage, it is possible to prevent occurrence of a thin spot in a printed image even when deterioration of the developer has progressed, as well as to prevent further deterioration of the developer.

Subsequently, the control section 200 receives an input for copying or printing in step S3.

In response to the input for copying or printing, the control section 200 performs image processing in step S4. Specifically, the image processing section 221 of the image processing board 220 produces image data items for the respective colors from image data.

Subsequently, the control section 200 performs step S5 of calculating the print coverage for the $i^{th}$ page. Specifically, the print coverage determining section 223 of the image processing board 220 calculates the print coverage which is the ratio of the number of dots to be printed to the maximum number of dots that can be printed for the image data item for black.

Figure 7:
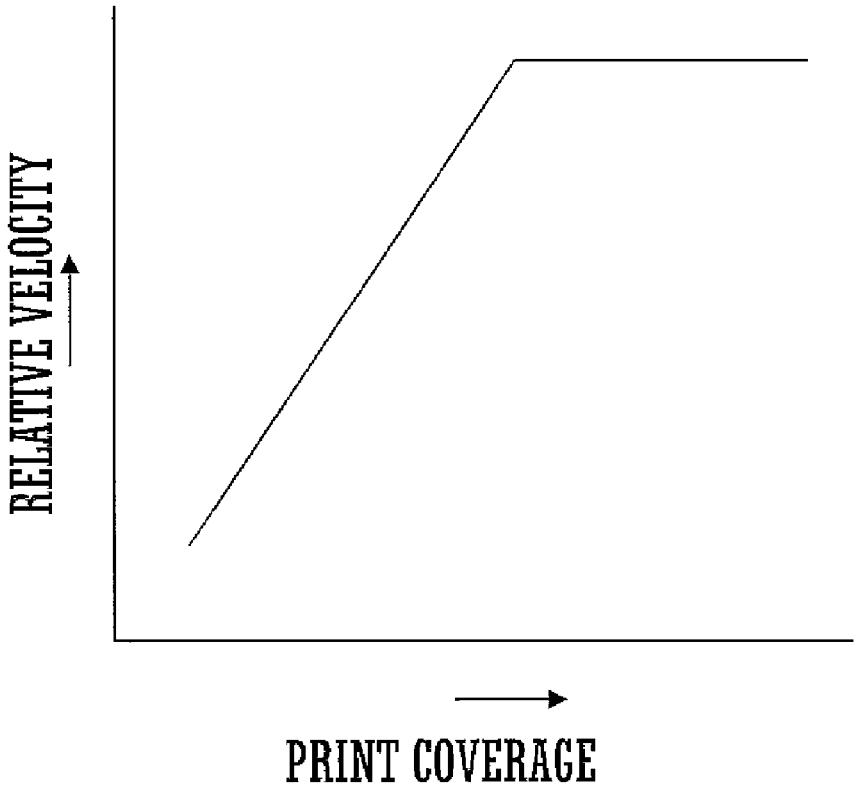
FIG. 7 is a diagram illustrating an exemplary relative velocity setting.

Subsequently, the control section 200 sets the relative velocity in step S6. Here, the control section 200 sets the rotating velocity of the developing roller 131 of the image forming unit 130A. Though this step will be described in detail later, adjustment is made so that the rotating velocity of the developing roller 131 is held constant at the aforementioned set value of the relative velocity when the print coverage is more than a predetermined threshold value, and reduced when the print coverage is less than the threshold value. FIG. 7 is a graph showing an exemplary relationship between an increase in developing bias voltage and a set value of an accelerating/decelerating value of the relative velocity.

By thus appropriately adjusting the rotating velocity of the developing roller 131 based on the print coverage for each image data item during image formation, the developing roller 131 can supply an adequate mount of toner to the photoreceptor drum 30 even when the print coverages for respective image data items vary largely during a period of continuous formation of plural images. Even in such a case, the developer can be prevented from excessively deteriorating because the rotating velocity of the developing roller 131 is decelerated appropriately as the print coverage lowers. When the print coverage for image data becomes higher than a certain degree, the likelihood of occurrence of a thin spot in a printed image is substantially constant even when the amount of toner to be supplied is increased. Therefore, deterioration of the developer can be prevented effectively by setting the rotating velocity of the developing roller 131 constant at the predetermined value when the print coverage is more than the predetermined threshold value.

Subsequently, the control section 200 performs step S7 of forming an image with the developing roller 131 driven at the rotating velocity described above.

Subsequently, the control section 200 performs step S8 of determining whether or not the next page exists. If it is determined that the next page exists, the process returns to step S5. If it is determined that the next page does not exist, the process returns to step S3.

Figure 8:
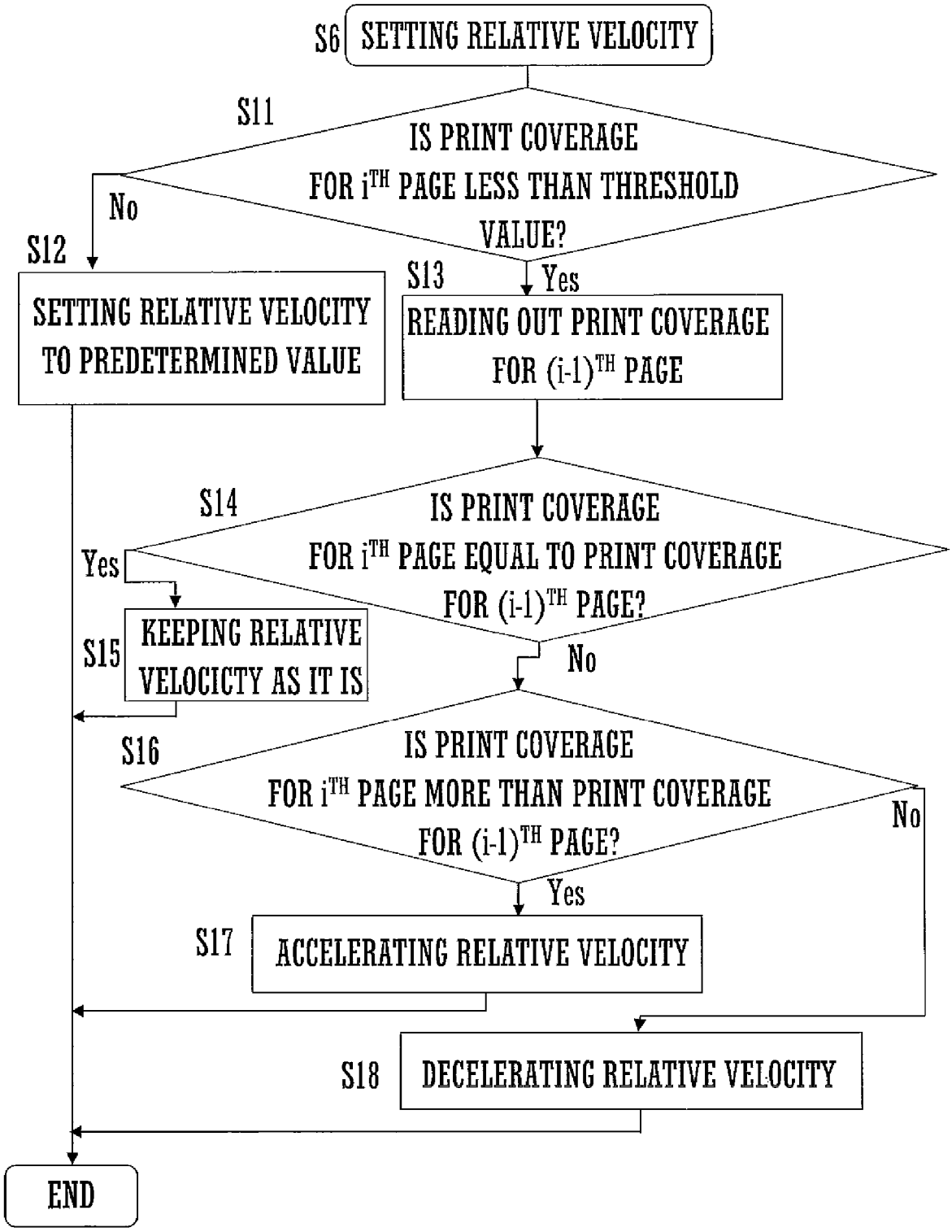
FIG. 8 is a flowchart illustrating another exemplary control flow for setting a relative velocity.

FIG. 8 is a detailed flowchart illustrating one exemplary flow of the relative velocity setting process carried out in step S6.

In the relative velocity setting process, the control section 200 performs step S11 of determining whether or not the print coverage for the $i^{th}$ page is less than the threshold value.

Specifically, the CPU 211 of the machine controller board 210 reads the print coverage data for the latest image data and the threshold value out of the memory 213 and compares the two.

If the print coverage for the $i^{th}$ page is more than the threshold value, the control section 200 performs step S12 of setting the relative velocity to the predetermined value. Specifically, the CPU 211 of the machine controller board 210 sets the rotating velocity of the developing roller 131 to the predetermined value. By so doing, the developer can be prevented from deteriorating even when the print coverage for the image data is higher than a certain degree.

If the print coverage for the $i^{th}$ page is less than the threshold value, the control section 200 performs step S13 of reading out the print coverage for the $(i-1)^{th}$ page. Specifically, the CPU 211 of the machine controller board 210 reads data on the print coverage for the last image data which has been already finished with image formation out of the memory 213.

Subsequently, the control section 200 performs steps S14 and S16 of comparing the print coverage for the $i^{th}$ page with the print coverage for the $(i-1)^{th}$ page. If the two are equal to each other, the control section 200 sets the relative velocity without changing the relative velocity set last in step S15. If the print coverage for the $i^{th}$ page is more than the print coverage for the $(i-1)^{th}$ page, the relative velocity is accelerated from the relative velocity set last in step S17. If the print coverage for the $i^{th}$ page is less than the print coverage for the $(i-1)^{th}$ page, the relative velocity is decelerated from the relative velocity set last in step S18. In adjusting the relative velocity, the difference between the last print coverage and the current print coverage is multiplied by a change in relative velocity per unit change in print coverage and then the value thus obtained is added to the relative velocity set last to have a newly set relative velocity.

While the foregoing embodiment is configured to set the relative velocity based on the print coverage for preceding image data, the relative velocity need not necessarily be set based on the print coverage for preceding image data. For example, it is possible to set the relative velocity by arithmetic calculation or by using a relative velocity table previously stored.

Figure 9:
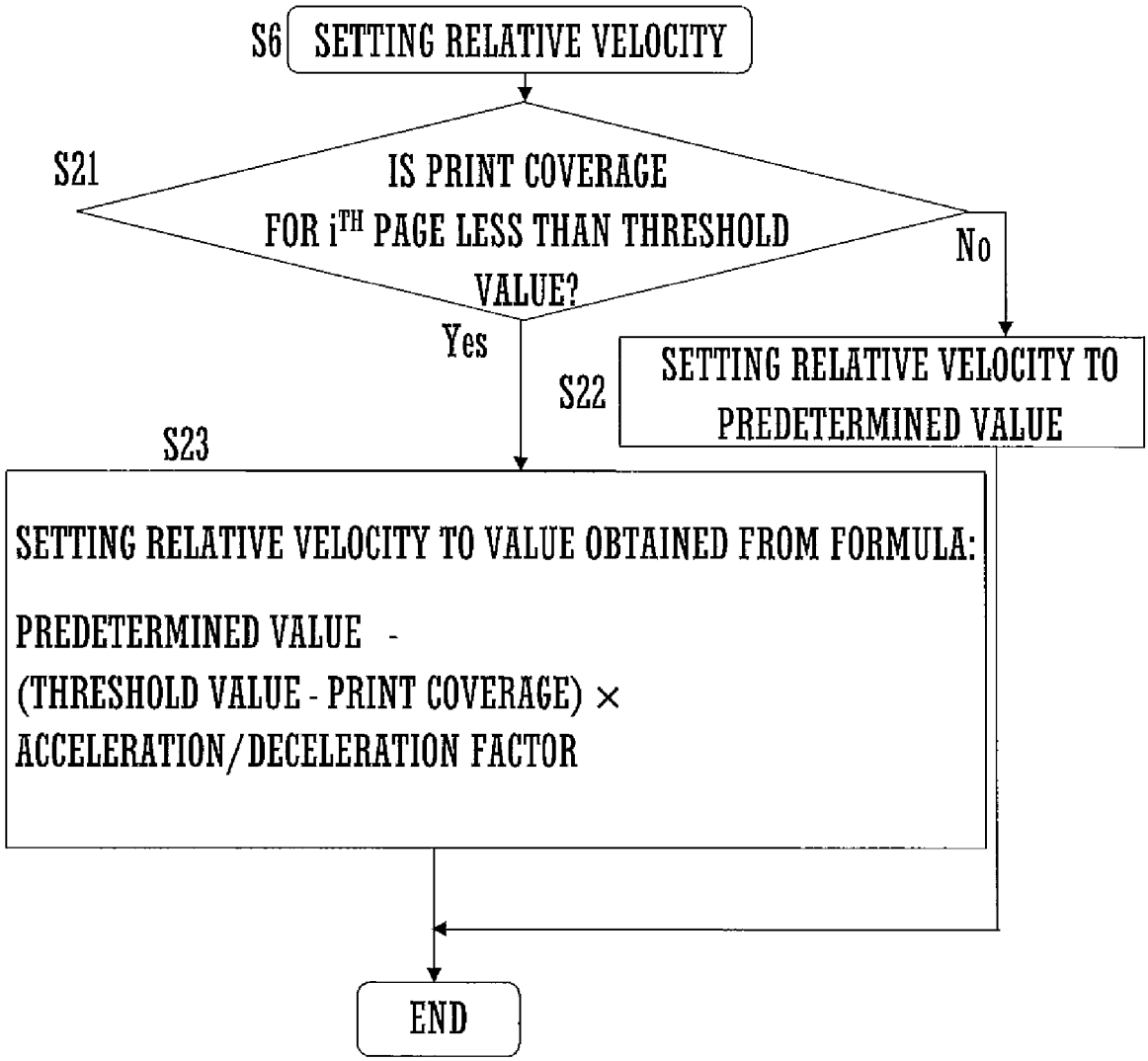
FIG. 9 is a flowchart illustrating yet another exemplary control flow for setting a relative velocity.

FIG. 9 is a detailed flowchart illustrating another exemplary flow of the relative velocity setting process based on arithmetic calculation carried out in step S6.

In the relative velocity setting process, the control section 200 performs step S21 of determining whether or not the print coverage for the $i^{th}$ page is less than the threshold value. If the print coverage for the $i^{th}$ page is more than the threshold value, the control section 200 performs step 22 of setting the relative velocity to the predetermined value. If the print coverage for the $i^{th}$ page is less than the threshold value, the control section 200 performs step S23 of setting the relative velocity to a value obtained by multiplying the difference resulting from subtraction of the print coverage from the threshold value by the aforementioned accelerating/decelerating value obtained based on the average bias voltage in step S2 and then subtracting the product thus obtained from the aforementioned predetermined value. The relative velocity may be set by such a control flow.

Figure 10:
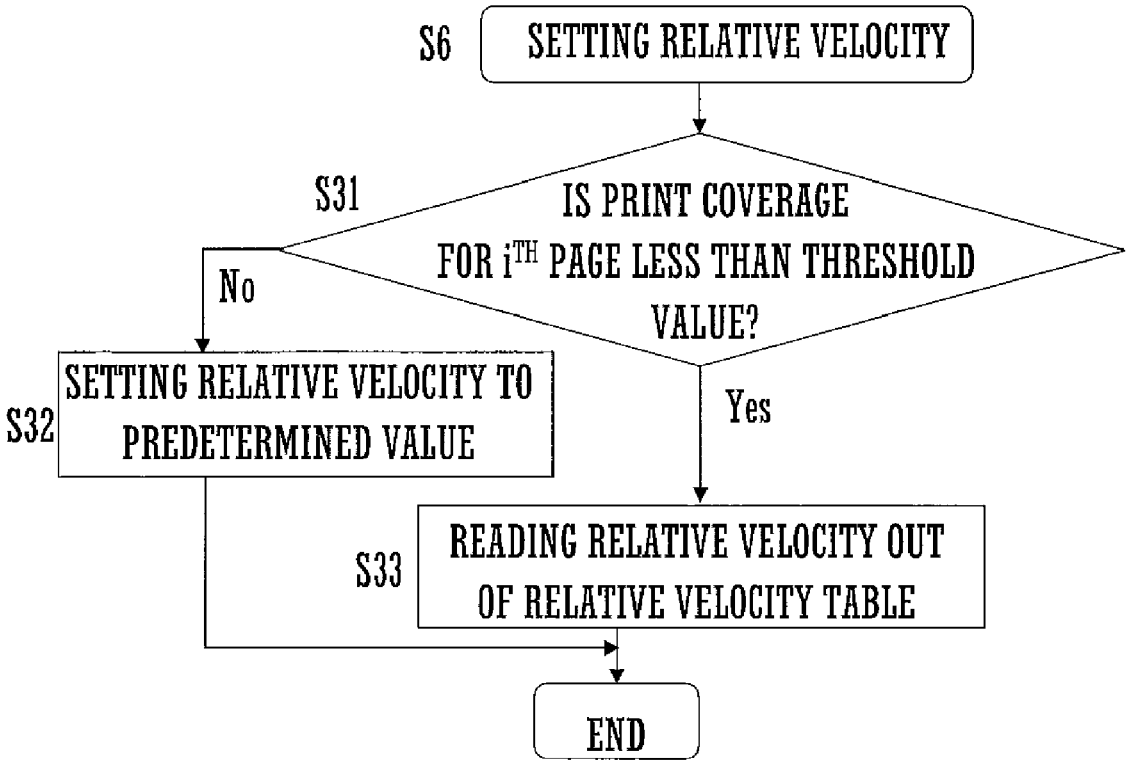
FIG. 10 is a flowchart illustrating yet another exemplary control flow for setting a relative velocity.

FIG. 10 is a detailed flowchart illustrating another exemplary flow of the relative velocity setting process carried out in step S6.

In the relative velocity setting process, the control section 200 performs step S31 of determining whether or not the print coverage for the $i^{th}$ page is less than the threshold value. If the print coverage for the $i^{th}$ page is more than the threshold value, the control section 200 performs step S32 of setting the relative velocity to the predetermined value. If the print coverage for the $i^{th}$ page is less than the threshold value, the control section 200 performs step S33 of setting the relative velocity by reading a relative velocity corresponding to the print coverage out of a relative velocity table previously stored in the memory 213.

The arrangement described above makes it possible to properly adjust the relative velocity between the photoreceptor drum and the developing roller and suppress deterioration of the developer while maintaining a high level of supply of toner to the photoreceptor drum, thereby to suppress occurrence of a defective image quality.

EXAMPLES

The following description is directed to the results of image forming experiments using a copier (trade name: MX-7000N, manufactured by SHARP CORPORATION) as an image forming apparatus. In the experiments, the fluidity of a developer was measured using a fluidity measuring device (trade name: VIBRATION TRANSFER FLUIDITY METER, manufactured by ETWAS CORPORATION). The density of an image was measured using a portable spectrocolorimetric densitometer (trade name: X-Rite 939, manufactured by X-Rite Corporate).

Evaluation Experiment in Continuous Printing at a Constant Print Coverage

Continuous image formation on 10,000 recording sheets was carried out by the copier while keeping constant a combination of the peripheral velocity ratio between the developing roller and the photoreceptor drum and the print coverage. Thereafter, fluidity evaluation was conducted by putting the developer collected from the copier into the fluidity measuring device. Images printed by the copier were evaluated for their densities by measurement using the portable spectrocolorimetric densitometer. The results of the evaluations are shown in Table 1.

TABLE 1

| | Print Coverage | PVR | DD | TS | CE |
|---|---|---|---|---|---|
| EXAMPLE 1 | 3% | −10% | B | A | A |
| EXAMPLE 2 | 3% | −20% | A | B | A |
| EXAMPLE 3 | 10% | −20% | B | B | A |
| EXAMPLE 4 | 0% | −20% | A | B | A |
| COMPARATIVE EXAMPLE 1 | 10% | −21% | A | F | F |
| COMPARATIVE EXAMPLE 2 | 11% | −20% | A | F | F |
| COMPARATIVE EXAMPLE 3 | 3% | 0% | F | A | F |

With respect to the peripheral velocity ratio (PVR) column in Table 1, the percentages of peripheral velocity ratios are based on a reference value of peripheral velocity ratio at which no thin spot occurred when A4 sheets were subjected to non-selective solid printing at each print coverage set. In example 1 for example, continuous image formation of a solid image was carried out on 10,000 sheets at a print coverage of 3% with the peripheral velocity ratio varied −10% from the reference value.

In Table 1, the column of developer deterioration (DD) shows evaluations of the results of measurement of developer outflow start time using the fluidity measuring device charged with 2 g of the developer and set at a voltage of 60 V and a frequency of 137 Hz. Based on the fact that non-deteriorated fresh developer put in the fluidity measuring device exhibited a developer outflow start time of less than 5 minutes, an example exhibiting a developer outflow start time of less than 5 minutes was evaluated as "A" which means a degree comparable to the degree exhibited by the non-deteriorated fresh developer; an example exhibiting a developer outflow start time of less than 7 minutes was evaluated as "B" which means such a degree as not allow a defective image quality to occur; and an example exhibiting a developer outflow start time of not less than 7 minutes was evaluated as "F" which means an unsatisfactory degree.

With respect to the column of thin spot (TS) in Table 1, an example exhibiting a density of not less than 1.5 was evaluated as "A" which means such a level as not to allow any thin spot to be visually observed; an example exhibiting a density of less than 1.5 and not less than 1.4 was evaluated as "B" which means such a level as to allow few thin spot to be visually observed; and an example exhibiting a density of less than 1.4 was evaluated as "F" which means such a level as to allow a thin spot to be visually observed clearly.

With respect to the column of comprehensive evaluation (CE) in Table 1, an example not evaluated as "F" with respect to the evaluation of developer deterioration or the evaluation of thin spot was evaluated as "A" which means good, while an example evaluated as "F" with respect to either or both of the evaluations of developer deterioration and thin spot was evaluated as "F" which means bad.

As can be seen from comparison between the cases where the print coverage was 3%, comparative example 3 in which the peripheral velocity ratio was varied 0% (i.e., not reduced) from the reference value exhibited more serious deterioration of developer than any one of examples 2 and 1 in which the peripheral velocity ratios were varied −20% and −10%, respectively, from the reference value. This proves that the developer can be prevented from deteriorating by reducing the peripheral velocity ratio.

As can be seen from comparison between the cases where the print coverage was 10%, comparative example 1 in which the peripheral velocity ratio was varied −21%, which was larger than in example 3, from the reference value allowed a thin spot to occur, whereas example 3 in which the peripheral velocity ratio was varied −20% from the reference value allowed few thin spot to occur. This proves that occurrence of a thin spot can be prevented by setting the peripheral velocity ratio to within a predetermined range without largely reducing the peripheral velocity ratio.

As can be seen from comparison between the cases where the peripheral velocity ratio was varied −20% from the reference value, comparative example 2 in which the print coverage was 11%, which was more than that in any one of examples 4, 2 and 3, allowed a thin spot to occur, whereas examples 4, 2 and 3 in which the print coverages were 0%, 3% and 10%, respectively, allowed few thin spot to occur. This proves that a thin spot occurs more easily with increasing print coverage when the peripheral velocity ratio is reduced largely.

Evaluation Experiment in Continuous Printing at Varying Print Coverage

Continuous image formation on 10,000 recording sheets was carried out by the copier while varying the print coverage for every 2,000 sheets. Peripheral velocity ratios set for respective of different print coverages in each setting example are shown in Table 2.

TABLE 2

| | | Print Coverage | | | | |
|---|---|---|---|---|---|---|
| | | 6% | 7% | 8% | 9% | 10% over |
| PERIPHERAL VELOCITY RATIO (PVR) | EXAMPLE 5 to 11 | −10% | −9% | −8% | −7% | −6% |
| | COMPARATIVE EXAMPLE 4 | −5% | −5% | −5% | −5% | −5% |
| | COMPARATIVE EXAMPLE 5 | −6% | −7% | −8% | −9% | −10% |
| | COMPARATIVE EXAMPLE 6 | −10% | −10% | −10% | −10% | −10% |
| | COMPARATIVE EXAMPLE 7 | −6% | −7% | −8% | −9% | −10% |

With respect to horizontal rows of the peripheral velocity ratio (PVR) in Table 2, the percentages of peripheral velocity ratios are based on a reference value of peripheral velocity ratio at which no thin spot occurred when A4 sheets were subjected to non-selective solid printing at a print coverage of 10%.

Thereafter, fluidity evaluation was conducted by putting the developer collected from the copier into the fluidity measuring device. Images printed by the copier were evaluated for their densities by measurement using the portable spectrocolorimetric densitometer. The results of evaluations are shown in Table 3.

TABLE 3

| | Print Coverage | | | | | | | |
|---|---|---|---|---|---|---|---|---|
| | 1 to 2000 SHEETS | 2001 to 4000 SHEETS | 4001 to 6000 SHEETS | 6001 to 8000 SHEETS | 8001 to 10000 SHEETS | DD | TS | CE |
| EXAMPLE 5 | 10% | 9% | 8% | 7% | 6% | B | A | A |
| EXAMPLE 6 | 6% | 7% | 8% | 9% | 10% | A | B | A |
| EXAMPLE 7 | 6% | 6% | 15% | 15% | 15% | B | B | A |
| EXAMPLE 8 | 15% | 15% | 20% | 20% | 20% | B | B | A |
| EXAMPLE 9 | 20% | 20% | 15% | 15% | 15% | B | B | A |
| EXAMPLE 10 | 6% | 6% | 6% | 6% | 6% | A | B | A |
| EXAMPLE 11 | 15% | 15% | 15% | 15% | 15% | B | B | A |
| COMPARATIVE EXAMPLE 4 | 10% | 9% | 8% | 7% | 6% | F | B | F |
| COMPARATIVE EXAMPLE 5 | 10% | 9% | 8% | 7% | 6% | F | B | F |
| COMPARATIVE EXAMPLE 6 | 6% | 7% | 8% | 9% | 10% | B | F | F |
| COMPARATIVE EXAMPLE 7 | 6% | 7% | 8% | 9% | 10% | B | F | F |

As can be seen from Table 3, any one of comparative examples 4 and 6 in each of which the peripheral velocity ratio was not varied with varying print coverage and comparative examples 5 and 7 in each of which the peripheral velocity ratio was reduced with increasing print coverage or increased with decreasing print coverage, allowed developer deterioration (DD) or a thin spot (TS) to occur more easily. Deterioration of developer (DD) was likely particularly where the print coverage decreased as the continuous image formation progressed. A thin spot (TS) was likely to occur particularly where the print coverage increased as the continuous image formation progressed. Examples 5 to 11, on the other hand, were evaluated excellent or good with respect to both of the evaluation of developer deterioration (DD) and the evaluation of thin spot (TS).

Evaluation Experiment with Developing Bias Voltage Increased

Continuous printing of an image having a print coverage of 3% on 10,000 recording sheets was carried out by the copier with the peripheral velocity ratio varied −15% from the reference value, and then the main body of the copier was powered OFF and allowed to stand for 12 hours. Thereafter, the main body was started up to again carry out continuous printing of the image having a print coverage of 3% on 10,000 recording sheets with the peripheral velocity ratio varied from the peripheral velocity ratio set last. In the experiment, there was used a developer which allowed the average developing bias voltage to assume −300 V just before the main body was powered OFF and assume −350 V after the process control having been performed at the time of start-up of the main body.

Thereafter, fluidity evaluation was conducted by putting the developer collected from the copier into the fluidity measuring device. Images printed by the copier were evaluated for their densities by measurement using the portable spectrocolorimetric densitometer. The results of evaluations are shown in Table 4.

TABLE 4

| | PERIPHERAL VELOCITY RATIO SET AFTER START-UP | DD | TS | CE |
|---|---|---|---|---|
| EXAMPLE 12 | −10% | B | A | B |
| COMPARATIVE EXAMPLE 8 | −15% | B | F | F |
| COMPARATIVE EXAMPLE 9 | −20% | B | F | F |

With respect to the peripheral velocity ratio column in Table 4, the percentages of peripheral velocity ratios are based on a reference value of peripheral velocity ratio at which no thin spot occurred when A4 sheets were subjected to non-selective solid printing at a print coverage of 3%.

As can be seen from Table 4, in the cases where the developing bias voltage value was increased after the process control having been performed at the time of start-up of the main body as compared with the average developing bias voltage value assumed before powering-OFF, comparative example 8 in which the peripheral velocity ratio was not varied and comparative example 9 in which the peripheral velocity ratio was reduced, allowed a thin spot (TS) to occur easily. Example 12, on the other hand, was evaluated excellent or good with respect to both of the evaluation of developer deterioration (DD) and the evaluation of thin spot (TS).

It was confirmed from the results of experiments described above that examples 1 to 12 each employing the arrangement of the present invention were capable of suppressing deterioration of the developer and occurrence of a thin spot in a printed image.

The foregoing embodiments are illustrative in all points and should not be construed to limit the present invention. The scope of the present invention is defined not by the foregoing embodiment but by the following claims. Further, the scope of the present invention is intended to include all modifications within the scopes of the claims and within the meanings and scopes of equivalents.

While the foregoing embodiments are directed to image formation using a two-component developer, the present invention is not limited to the use of such a two-component developer. The present invention can offer a similar advantage even when a one-component developer is used. However, an arrangement using the two-component developer is desirable because the image quality is less likely to lower even when a change is caused in friction between carrier particles, between toner particles or between the toner and the doctor blade by varying the relative velocity.

What is claimed is:

1. An image forming apparatus comprising:

an image bearing member configured to form an electrostatic latent image on a surface thereof in accordance with image data;

a developer bearing member having a developer bearing surface at least a partial region of which faces the image bearing member and configured to be driven so as to feed a developer to the image bearing member;

a required amount detecting section configured to detect a detection value related to an amount of toner required by an image to be formed during image formation in accordance with image data;

a velocity adjusting section configured to set a relative velocity of the developer bearing member to the image bearing member to a predetermined value when the detection value is equal to and more than a threshold value and set the relative velocity to a lower value than the predetermined value when the detection value is less than the threshold value;

a bias voltage detecting section configured to detect a developing bias voltage value; and a nonvolatile storage section configured to store therein a developing bias voltage value obtained before powering-OFF, wherein the velocity adjusting section is configured to correct a set value of the relative velocity to a higher value when an absolute value of a developing bias voltage value which is detected by the bias voltage detecting section after powering-ON is more than an absolute value of an average value of developing bias voltages previously stored in the nonvolatile storage section.

2. The image forming apparatus according to claim 1, wherein the velocity adjusting section is configured to control an operation of the image bearing member and an operation of the developer bearing member.

3. The image forming apparatus according to claim 1, which includes an image bearing member velocity adjusting section configured to control an operation of the image bearing member.

4. The image forming apparatus according to claim 1, wherein the developer comprises a non-magnetic toner and a magnetic carrier.

5. The image forming apparatus according to claim 1, wherein the required amount detecting section is configured to detect a print coverage for the image data as the detection value.

6. The image forming apparatus according to claim 1, wherein the velocity adjusting section is configured to decelerate the relative velocity in accordance with the detection value when the detection value is less than the threshold value.

7. The image forming apparatus according to claim 1, wherein the velocity adjusting section is configured to obtain the relative velocity from a table previously stored in memory based on the detection value.

8. An image forming apparatus comprising:

an image bearing member configured to form an electrostatic latent image on a surface thereof in accordance with image data;

a developer bearing member having a developer bearing surface at least a partial region of which faces the image bearing member and configured to be driven so as to feed a developer to the image bearing member;

a required amount detecting section configured to detect a detection value related to an amount of toner required by an image to be formed during image formation in accordance with image data; and a velocity adjusting section configured to set a relative velocity of the developer bearing member to the image bearing member to a predetermined value when the detection value is equal to and more than a threshold value and set the relative velocity to a lower value than the predetermined value when the detection value is less than the threshold value, wherein the velocity adjusting section is configured to obtain the relative velocity based on the detection value by performing an arithmetic calculation of the formula:

the relative velocity=the predetermined value−(the threshold value−the detection value)×an acceleration/deceleration factor.

9. The image forming apparatus according to claim 8, wherein the velocity adjusting section is configured to control an operation of the image bearing member and an operation of the developer bearing member.

10. The image forming apparatus according to claim 8, which includes an image bearing member velocity adjusting section configured to control an operation of the image bearing member.

11. The image forming apparatus according to claim 8, which includes a bias voltage detecting section configured to detect a developing bias voltage value, and a nonvolatile storage section configured to store therein a developing bias voltage value obtained before powering-OFF, wherein the velocity adjusting section is configured to correct a set value of the relative velocity to a higher value when an absolute value of a developing bias voltage value which is detected by the bias voltage detecting section after powering-ON is more than an absolute value of an average value of developing bias voltages previously stored in the nonvolatile storage section.

12. The image forming apparatus according to claim 8, wherein the developer comprises a non-magnetic toner and a magnetic carrier.

13. The image forming apparatus according to claim 8, wherein the required amount detecting section is configured to detect a print coverage for the image data as the detection value.

14. The image forming apparatus according to claim 8, wherein the velocity adjusting section is configured to decelerate the relative velocity in accordance with the detection value when the detection value is less than the threshold value.

* * * * *